United States Patent [19]

Curry

[11] 4,265,215

[45] May 5, 1981

[54] SPACE HEATER

[76] Inventor: Earle Curry, 116 Purchase St., South Easton, Mass. 02375

[21] Appl. No.: 47,684

[22] Filed: Jun. 12, 1979

[51] Int. Cl.[3] ..... F24C 1/14; F24C 5/00; F24H 3/00; F24B 3/00

[52] U.S. Cl. ..... 126/77; 126/58; 126/15 R; 126/112; 126/66

[58] Field of Search ..... 126/77, 112, 15 R, 15 A, 126/58, 66

[56] References Cited

U.S. PATENT DOCUMENTS

| | | | |
|---|---|---|---|
| 746,939 | 12/1903 | Evans | 126/77 |
| 749,059 | 1/1904 | Helwig et al. | 126/77 |
| 835,301 | 11/1906 | Decker | 126/77 |
| 852,209 | 4/1907 | Watson, Sr. | 126/77 |
| 1,108,977 | 9/1914 | Doyle | 126/77 |
| 1,123,725 | 1/1915 | Putral | 126/77 |
| 1,596,922 | 8/1926 | Clevenger et al. | 126/112 |
| 2,967,522 | 1/1961 | Takahashi | 126/77 |

FOREIGN PATENT DOCUMENTS

| | | | |
|---|---|---|---|
| 1548 | of 1908 | United Kingdom | 126/77 |

*Primary Examiner*—Samuel Scott
*Assistant Examiner*—Wesley S. Ratliff, Jr.
*Attorney, Agent, or Firm*—Frank J. Fleming

[57] ABSTRACT

A passive type of space heater having a vertical air heating duct located at the rear of the combustion chamber and a flue duct extending through the air heating duct with its inlet located so as to draw the flue gases from the combustion chamber around the surfaces of the air heating duct. Air for combustion is supplied to the top of the combustion chamber by an air supply duct which extends inside of the flue duct and has orifices to provide air in the flue duct for secondary combustion of the flue gases passing through the flue duct. The air supply duct also has an ejector to draw a portion of the flue gases into the air supply duct for recirculation to the combustion chamber for tertiary combustion. A separate air supply duct is provided for supplying air for combustion during start-up.

7 Claims, 3 Drawing Figures

SPACE HEATER

FIELD OF THE INVENTION

The present invention relates to space heaters designed to be connected to a building flue to burn gas, oil, coal or wood and particularly a passive type of space heater which provides an efficient transfer of heat to the space around the heater without using additional energy to circulate the air to be heated.

DESCRIPTION OF THE PRIOR ART

This invention is in a crowded field of art. Some of the principles and elements of the invention may be found individually in the prior art, but no where shown, as far as I am aware, is the entire combination and arrangement as disclosed in my invention.

For example, Wilson U.S. Pat. No. 3,312,212 discloses a heat generating apparatus in which a flue duct draws the flue gases from the bottom of the combustion chamber and extends vertically inside an air heating passage. The air heating passage in the Wilson apparatus is not located in the rear of the combustion chamber with the inlet for the flue gases located so as to draw the flue gases around the walls of the air heating passage. Instead, the walls of the combustion chamber form one wall of the air heating passage and the outer jacket of the apparatus requires a motor driven fan to circulate the air to be heated to the space to be heated.

Other examples are disclosed in "Woodstove Directory", Vol. II, 1979, published by Energy Communication Press, P. O. Box 4474, Manchester, N. H. On page 35 of this publication is disclosed the Defiance Volcano II wood burning stove, in which air for combustion is preheated and some preheated air is metered into a secondary combustion chamber to burn the flue gases. This stove does not disclose any means for drawing the flue gases around the walls of the air heating duct. It more or less follows the teachings of the Wilson patent in that the walls of the combustion chamber form one wall of the air heating passage and the outer jacket of the stove forms the other wall thereof. This stove also depends on a motor driven fan to circulate the air to be heated.

On page 136 of the above cited publication is disclosed the Oneida Royal furnace, in which the arrangement of the air heating passage is similar to that in the Volcano II stove metioned above. This stove also depends on a motor driven fan to circulate the air to be heated.

On page 139 of the above cited publication is disclosed the Surefire 101B Wood-burning Furnace in which the flue ducts and air heating ducts are located above the combustion chamber of the furnace. Although the exterior walls of the combustion chamber are exposed to the ambient air to be heated as in the present invention, the surfaces of the air heating duct are not exposed directly to the heat of combustion in the combustion chamber and no means for producing secondary combustion of the flue gases is provided.

Von Wiesenthal U.S. Pat. No. 3,965,885 discloses a heater having a helical fin mounted between a duct in which process fluid flows and the outer shell of the heater to lengthen the flow path of the flue gases and thus extract more heat from them. No secondary burning of the flue gases is disclosed in the section containing the helical fins. The transfer of heat through the metal fins is to one duct only and any heat transferred to the outer wall is lost.

The Circul-Air Stove manufactured by the Carroll Manufacturing Co., Syracuse, N.Y., is disclosed on Page 179 of "Wood Burning Quarterly," Winter 78, Vol, 3, No. 3. This stove discloses an air heating duct which passes underneath, around the back and across the top of the combustion chamber of the stove with only one side thereof forming a wall of the combustion chamber. The Circul-Air Stove does not have the exterior surfaces of its combustion chamber exposed directly to the ambient air to be heated. Neither does it disclose a flue duct inside of the air heating duct or means for drawing the flue gases around all of the exterior surfaces of the air heating duct.

SUMMARY OF THE INVENTION

It is an object of this invention to provide a space heater having a highly efficient heat exchange.

It is another object of this invention to provide a space heater which is highly efficient in reducing the heat losses into the flue.

It is still anotner object of this invention to provide a space heater which is highly efficient in burning the fuel.

It is a further object of this invention to provide a space heater which is highly efficient in both heat exchange and in burning fuel.

It is still a further object of this invention to provide a space heater which utilizes the heat from secondary combustion of the flue gases to improve the heat exchange efficiency.

It is still another object of this invention to provide a space heater which has means for recycling a portion of the flue gases for a tertiary burning thereof.

It still a further object of this invention to provide a space heater which preheats the air for combustion by utilizing the heat of the flue gases.

It is still another object of this invention to provide a space heater which utilizes the scondary combustion of the flue gases to improve similtaneously the heating of the air for combustion and the heat exchange.

It is still another object of this invention to provide a space heater which has a means for drawing the flue gases around an air heating duct in a manner which will result in an improved heat exchange.

It is another object of this invention to provide a space heater which is highly efficient in both heat exchange and in burning fuel without the need of using a motor driven blower.

The objects of this invention are achieved by the arrangement of the air supply for combustion and the paths provided for exhausting the flue gases from the combustion chamber of the space heater. The combustion chamber of the space heater has its outer surfaces exposed directly to the ambient air to be heated. An air heating duct which extends vertically through the rear section of the combustion chamber provides added heating surfaces. The outer surfaces of the air heating duct are, in part, heated by the radiant heat from the burning fuel and, in part, by the flue gases in the fuel burning section of the combustion chamber and, in part, by the flue gases in the rear section of the combustion chamber. A flue duct extends through the air heating duct into a flue chamber with its inlet located near the bottom of the wall of the air heating duct remote from the fule burning section of the combustion chamber so that the flue gases are drawn around the entire outer surface of the air heating duct. The flue chamber is provided with an outlet port which is adapted to be connected to a flue or chimney to exhaust the flue gases into the atmosphere. A flue passage with a damper in it is provided between the flue chamber and the combustion chamber. This flue passage with the damper in its open position is used when the fire is first ignited in the combustion chamber to exhaust the flue gases until a suitable draft has been created, then the damper is closed. Air for combustion is supplied at the top of the combustion chamber. During start-up, air is supplied through an air supply duct located near the front of the combustion chamber. A second air supply duct extends through the inlet of the flue duct and thence through the flue duct into the flue chamber and into the top of the fuel burning section of the combustion chamber. Orfices are provided in the second air supply duct near the point at which it enters the inlet of the flue duct to provide a secondary burning of the flue gases as they flow through the flue duct. To increase the length of the upward flow path of the flue gases, a helical fin is mounted inside of the flue duct between the second air supply duct and the inner surface of the flue duct. An ejector comprising a nozzle and an annular port in the second air supply duct is provided to draw off a portion of the flue gases flowing through the flue duct and recirculate them back into the fuel burning section of the combustion chamber for a tertiary burning of the portion recirculated. After start-up, the original air supply duct may be closed and all of the air for combustion supplied through the second air supply duct. It is also possible to operate the stove by opening door on the front thereof.

It has been found that the space heater constructed as described above is efficient in heating the ambient air because the entire outer surface of the combustion chamber provides heating surfaces and, in addition, heating surfaces are provided by the inner surface of the air heating duct and the outer surface of the flue duct. The secondary burning of the flue gases in the flue duct adds to the heat available for heating the air flowing through the air heating duct. It has also been found that when the fuel burned is wood, no deposits were detected on the surfaces of the flue duct, second air supply duct or the helical fin.

DESCRIPTION OF THE DRAWINGS

An understanding of the nature of this invention and an appreciation of its many advantages will best be gained from a study of the following description given in connection with the drawings in which.

DESCRIPTION OF PREFERRED EMBODIMENTS

Figure 1:
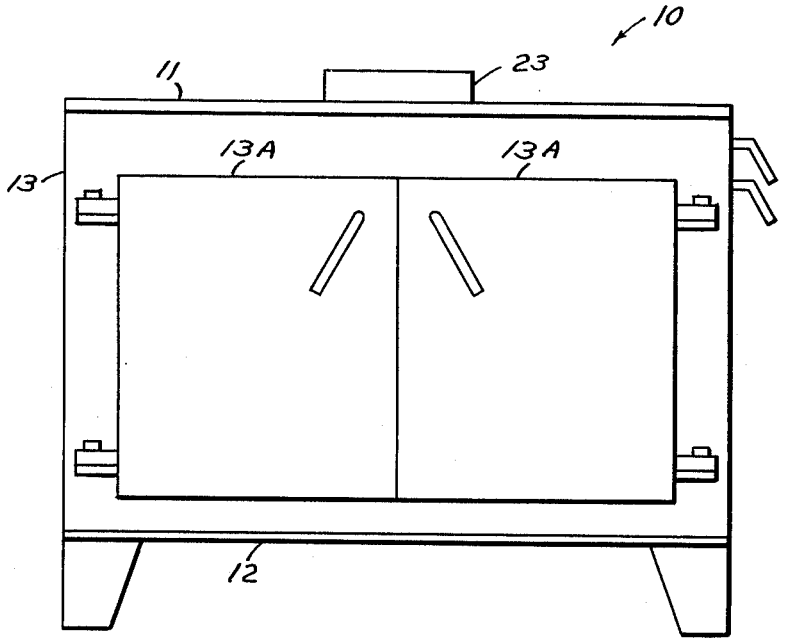
FIG. 1 is a front view of the space heater.
Figure 2:
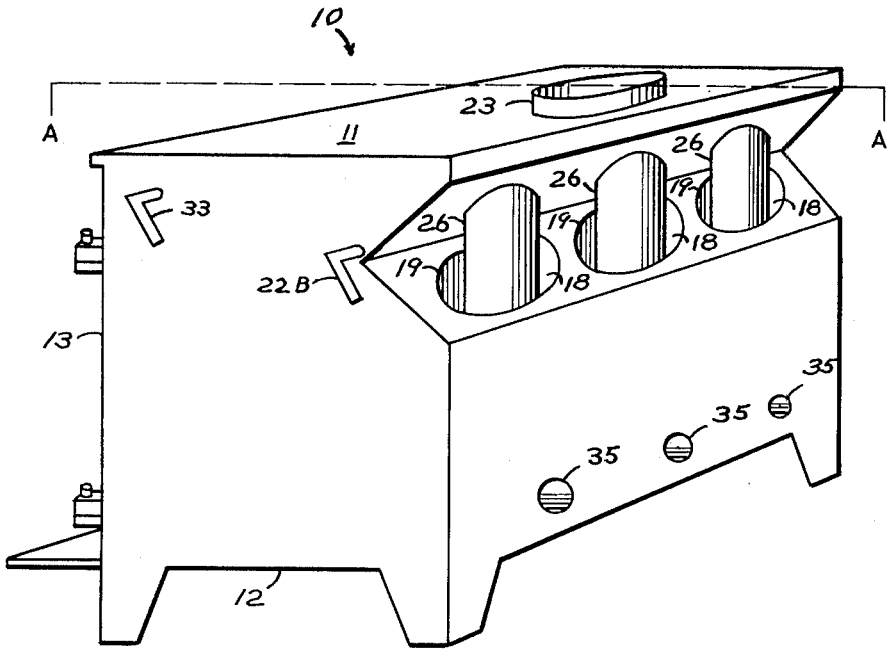
FIG. 2 is a perspective view showing the rear of the heater.
Figure 3:
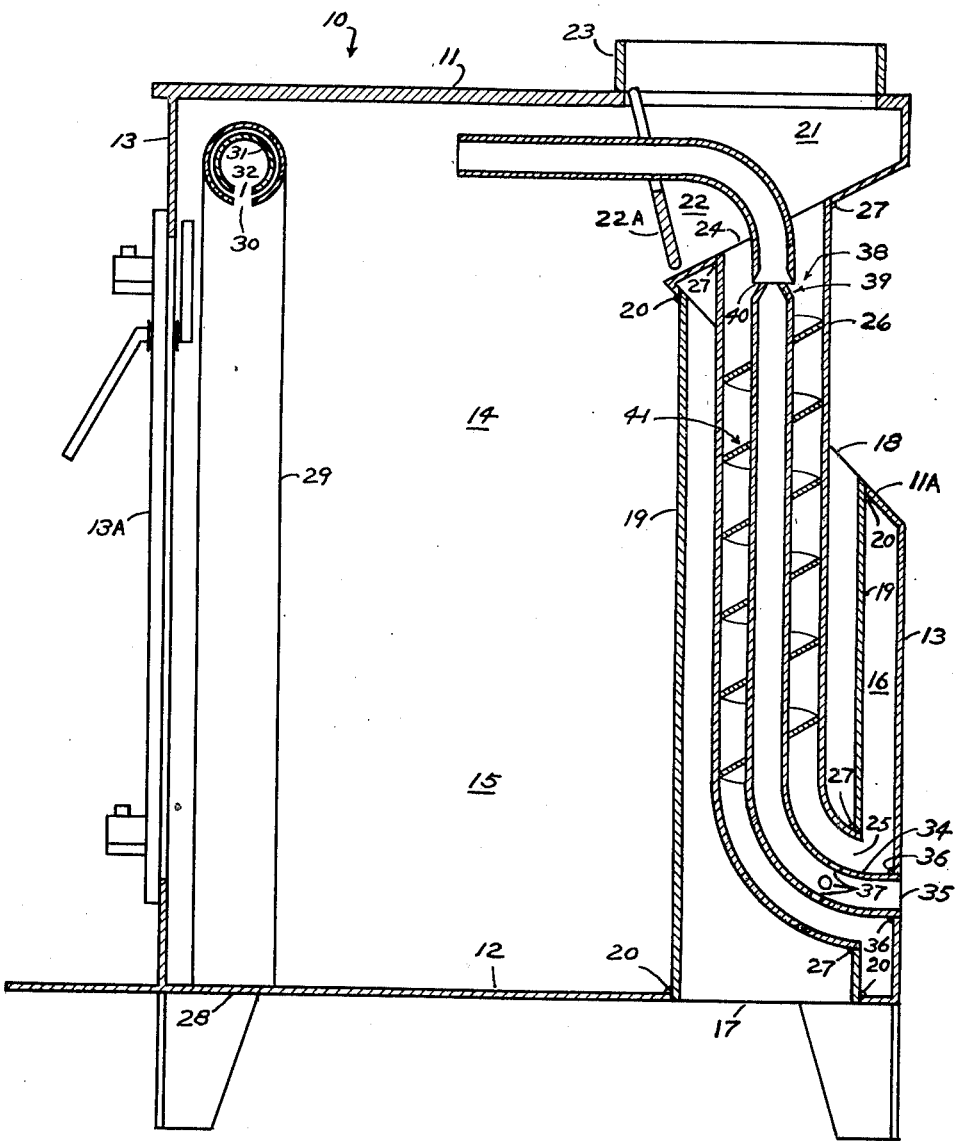
FIG. 3 is a cross section of the space heater taken along the line A–A of FIG. 2.

Referring to the FIGURES, space heater 10 has a top 11, bottom 12 and side walls 13 which form the combustion chamber 14. Combustion chamber 14 is divided into a fuel burning section 15 and a rear section 16. Front wall 13 includes as a part thereof doors 13*a* to provide access to fuel burning section 15 for supplying fuel such as wood, peat, coal or for servicing burners (not shown) when gas or oil is the fuel supplied. The outer surfaces of top 11, bottom 12 and side walls 13 are exposed directly to the ambient air to be heated. In bottom 12 within the rear section 16 is air inlet port 17 and in top 11*a* of rear section 16 is air outlet port 18. Air heating duct 19 extends vertically through rear section 16 from inlet port 17 to air outlet port 18. Air inlet port 17 and air outlet port 18 are located so that air heating duct 19 is spaced from side walls 13. Air heating duct 19 is hermetically sealed at 20 with respect to bottom 12 and top 11*a* to prevent the escape of flue gases into the ambient air. As disclosed in FIG. 2, several air heating ducts 19 may be used in space heater 10.

Flue chamber 21 is joined to fuel section 15 of combustion chamber 14 by flue passage 22. Flue chamber 21 has chamber outlet port 23 which is adapted to be connected to a flue or chimney (not shown) to exhaust the flue gases into the atmosphere remote from the ambient air to be heated. Flue chamber 21 also includes chamber inlet port 24. Damper 22*a* is mounted in flue passage 22 to manually regulate the flow of flue gases through flue passage 22 by the manipulation of handle 22*b*.

Flue gas inlet port 25 in air heating duct 19 is located in a position remote from fuel burning section 15 near bottom 12. Flue duct 26 extends inside air heating duct 19 from flue gas inlet port 25 to chamber inlet port 24 and is hermetically sealed at 27 with respect to air heating duct 19 and flue chamber 21 to prevent the escape of flue gases into the ambient air. As disclosed in FIG. 2, flue ducts 26 may be provided for each of the air heating ducts installed in space heater 10.

Bottom 12 includes air supply port 28. Air supply duct 29 extends inside fuel burning section 15 from air supply port 28 to a location adjacent top 11 and extends across fuel burning section 15. In the portion of air supply duct 29 which extends across the fuel burning section 15 is slot 30 to admit air for combustion into fuel burning section 15. Valve member 31 mounted inside of air supply duct 29 includes slot 32 which cooperates with slot 30 to control the flow of air into fuel burning section 15 when manually positioned by manipulation of handle 33.

Second air supply duct 34 extends from second air inlet port 35 in side wall 13, through flue gas inlet port 25 inside of flue duct 26 into flue chamber 21 and thence through flue passage 22 into fuel burning section 15 to discharge air for combustion into fuel burning section 15. Second air supply duct 34 is hermetically sealed at 36 to prevent the escape of flue gases into the ambient air. Several small orifices 37 are provided in the vicinity of flue gas inlet port 25 to supply air for the secondary combustion of the flue gases flowing through flue duct 26. Ejector 38, comprising nozzle 39 and annular port 40, is located below chamber inlet port 24. Ejector 38 draws a portion of the flue gases into second air supply duct 34 to return them to flue burning section 15 for reburning any unburned gases in the flue gases. A second air supply duct 34 may be supplied for each flue duct 26 included in space heater 10.

The operation of the space heater will now be described. During start-up, damper 22*a* is in its open position so that a maximum draft is created by the burning fuel to carry the flue gases through chamber outlet port 24. Also during start-up, valve member 31 is positioned to supply a maximum volume of air for combustion to fuel burning section 15. As a draft is created, a portion of the hot flue gases is drawn through flue duct 26 and thereby heats flue duct 26 to cause a draft to be created which is sufficient to operate spacer heater 10 with damper 22*a* moved to its closed position. As flue duct 26 heats up, the hot flue gases also heat second air supply duct 34, causing air to flow through it into fuel burning section 15. A portion of the air flowing through second air supply duct 34 flows through orifices 37 to provide air for the secondary combustion of the flue gases. The size and number of orifices 37 is easily determined by experimentation. As soon as secondary air supply duct 34 is sufficiently heated to cause a flow of air into fuel burning section 15, valve member 31 may be moved to its closed position.

When all of the air for combustion is flowing through second air supply duct 34, it becomes apparent that the velocity of air flow through second air supply duct 34 is greater than that through flue duct 26 because the same volume flows through each duct and flue duct 26 has a larger cross-section than second air supply duct 34. To further increase the velocity of flow, nozzle 39 is provided in second air supply duct 34. This causes a portion of the flue gases to be drawn through annular port 40 into second air supply duct 34 to be returned to fuel burning section 15 for tertiary combustion of the flue gases.

Helical fins 41 extend between second air supply duct 34 and flue duct 26 from a point just above orifices 37 to a point just below ejector 38. Helical fins 41 provide a longer flow path and thus increase the efficiency of the heat exchange to secondary air supply duct 34 and flue duct 26.

As can be appreciated from the above description, space heter 10 provides a highly efficient design for both heat transfer to the ambient air and for burning of the fuel. All surfaces of space heater 10 are exposed directly to the ambient air to be heated with no secondary surfaces to interfer with that direct heating. In addition, air heating duct 19 is arranged to provide a maximum flow of air through it. The air flowing through air heating duct 19 is exposed to its heated inner surface and also to the heated outer surface of flue duct 26. It should be particularly noted that the entire surface of air heating duct 19 is heated by flue gases as they are drawn from fuel burning section 15 around air heating duct 19 into air outlet port 17 located remote from fuel burning section 15. It should also be noted that flue duct 26 is heated by both the heat of the flue gases as they flow from fuel burning section 15 and by the secondary combustion which takes place in flue duct 26. In addition, the tertiary combustion of a portion of the flue gases resulting from the use of ejector 38 increases the heat available in space heater 10. Another means for increasing the efficiency of the heat exchange is the use of helical fins 41 which increases the length of the flow path of the flue gases through flue duct 26. An important reason for the efficient heat transfer is the efficient burning of the fuel by the secondary and tertiary combustion which leaves substantially clean surfaces in flue duct 26, secondary air supply duct 34 and helical fins 41.

I claim:

1. A space heater of the type adapted to be connected to a flue for exhausting flue gases therefrom, comprising in combination:

a combustion chamber having
a fuel burning section,
a rear section,
a top,
a bottom, and
side walls;

said top and said walls being arranged so that the outer surfaces thereof are exposed directly to the (ambient) room air to be heated and the inner surfaces thereof enclosing said fuel burning section are exposed directly to the heat of the burning fuel and to the flue gases therein and the inner surfaces thereof enclosing said rear section are exposed directly to the flue gases therein and said rear section having an air inlet port in said bottom and
an air outlet port in said top:
a flue gas chamber having
a chamber outlet port adapted to be connected to said flue and
a chamber inlet port:
a flue passage connecting said fuel burning section and said flue chamber:
a damper in said flue passage adapted to regulate the rate of flow of flue gases therethrough:
an air heating duct in said rear section connecting said air inlet port and said air outlet port in hermetically sealed relation to said bottom and to said top respectively, said air inlet port and said air outlet port being located so that said air heating duct is spaced from the side walls of said rear section, whereby the outer surface of said air heating duct facing said walls enclosing said rear section is exposed directly to the flue gases in the section between said outer surface and said wall and the inner surface of said air heating duct is exposed directly to the air in said air heating duct and thus transfers heat from said flue gases therein to the inner surface of said duct where it is available to heat the air in said duct and cause a convection flow of room air into said inlet port through said air heating duct and through said outlet port into the room space above the stove said air heating duct having a flue gas inlet port located adjacent to said bottom remote from said fuel burning section: a flue duct in said air heating duct connecting said flue gas inlet port in hermetically sealed relation to said air heating duct and to said flue chamber respectively: whereby, the heat in the flue gases flowing through said flue is readily transfered through the wall of said flue duct to the air in said air heating duct:
an air supply duct adapted to admit air for combustion into said fuel burning section at a point adjacent to said top and remote from said rear section:
whereby when fuel is burning in said fuel burning section, the flue gases are drawn around said air heating duct into and through said flue duct to be exhausted through said flue chamber and chamber outlet port into said flue, (.), and when said damper in said flue duct is in its open position, part of the flue gases in said combustion chamber flow through said flue passage to said flue and the other portions of said flue gases flow through said flue duct to said flue and when said damper in said passage is in its closed position, all of said flue gases in said combustion chamber flow from said combustion chamber through said flue passage to said flue.

2. A space heater as claimed in claim 1 wherein said air supply duct extends downwardly inside said fuel burning section to thereby provide means for preheating said air supplied for combustion.

3. A space heater as claimed in claim 1 wherein said combination further comprises:

an air supply port in said combustion chamber near said flue gas inlet port;

a second air supply duct having one end thereof connected to said air supply port in hermetically sealed relation to said combustion chamber and extending through said flue gas inlet port, said flue duct, said flue chamber and said flue passage into said flue burning section to provide air for combustion.

4. A space heater as claimed in claim 3 wherein said combination further comprises:

an air supply damper in said air supply inlet duct adapted to regulate the rate of flow of air therethrough.

5. A space heater as claimed in claim 3 wherein said second air supply duct further comprises:

orifices adapted to supply air for the secondary combustion of the flue gases in said flue duct.

6. A space heater as claimed in claim 3 wherein said second air supply duct further comprises an ejector comprising a nozzle and an annular port adapted to draw a portion of the flue gases in said flue duct into said second air supply duct.

7. A space heater of the type adapted to be connected to a flue for exhausting flue gases therefrom, comprising, in combination:

a combustion chamber having a flue burning section, a rear section, a top, a bottom and side walls;

said top and said side walls being arranged so that the outer surfaces thereof are exposed directly to the ambient air to be heated and the inner surfaces thereof enclosing said fuel burning section are exposed directly to the heat of the burning fuel and to the flue gases therein and the inner surfaces thereof enclosing said rear section are exposed directly to the flue gases therein;

said side wall in the front of said fuel burning section having an openable door, which, when open, supplies air for combustion;

said rear section having an air inlet port in said bottom and an air outlet port in said top:

a flue gas chamber having a chamber outlet port adapted to be connected to said flue and a chamber inlet port:

a damper in said flue passage adapted to regulate the rate of flow of flue gases therethrough:

an air heating duct in said rear section connecting said air inlet port and said air outlet port in hermetically sealed relation to said bottom and to said top respectively, said air inlet port and said air outlet port being located so that said air heating duct is spaced from the side walls of said rear section, said air heating duct having a flue gas inlet port located adjacent to said bottom remote from said fuel burning section:

a flue duct in said air heating duct connecting said flue gas inlet port and said chamber inlet port in hermetically sealed relation to said air heating duct and to said flue chamber respectively:

whereby when fuel is burning in said fuel burning section, the flue gases are drawn around said air heating duct into and through said flue duct to be exhausted through said flue chamber and chamber outlet port into said flue.

* * * * *